US011040385B2

(12) United States Patent
Chen et al.

(10) Patent No.: US 11,040,385 B2
(45) Date of Patent: Jun. 22, 2021

(54) COOLING SECTION COMPRISING POWER COOLING AND LAMINAR COOLING

(71) Applicant: PRIMETALS TECHNOLOGIES AUSTRIA GMBH, Linz (AT)

(72) Inventors: Jian Chen, St. Marien (AT); Sieglinde Ehgartner, Linz (AT); Reinhard Karl, Klosterneuburg (AT); Erich Opitz, Moenchhof (AT); Florian Poeschl, Linz (AT); Alois Seilinger, Linz (AT); Thomas Trickl, Koppl (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 257 days.

(21) Appl. No.: 16/059,125

(22) Filed: Aug. 9, 2018

(65) Prior Publication Data

US 2018/0345343 A1 Dec. 6, 2018

Related U.S. Application Data

(62) Division of application No. 14/768,097, filed as application No. PCT/EP2014/052388 on Feb. 7, 2014, now Pat. No. 10,076,778.

(30) Foreign Application Priority Data

Feb. 15, 2013 (EP) ..... 13155337

(51) Int. Cl.
*B21B 45/02* (2006.01)
*B21B 37/74* (2006.01)
(Continued)

(52) U.S. Cl.
CPC ..... *B21B 45/0215* (2013.01); *B21B 37/74* (2013.01); *B21B 45/0218* (2013.01);
(Continued)

(58) Field of Classification Search
CPC ..... B21B 37/44; B21B 37/74; B21B 37/76; B21B 45/0209; B21B 45/0215;
(Continued)

(56) References Cited

U.S. PATENT DOCUMENTS 3,423,254 A 1/1969 Safford et al.
4,720,310 A 1/1988 Viannay et al.
(Continued)

FOREIGN PATENT DOCUMENTS

CN 2261898 Y 9/1997
CN 2675279 Y 2/2005
(Continued)

OTHER PUBLICATIONS

May 9, 2014 International Search Report issued in corresponding patent app. No. PCT/EP2014/052388.
(Continued)

*Primary Examiner* — Peter Dungba Vo
*Assistant Examiner* — Joshua D Anderson
(74) *Attorney, Agent, or Firm* — Ostrolenk Faber LLP

(57) ABSTRACT

A cooling section for flat rolling stock has a working region, through which the flat rolling stock is guided. The working region can be supplied with a liquid coolant by means of a number of spray beams. The liquid coolant is fed from a reservoir for the liquid coolant to the spray beams by means of a pump and a supply system. Valves are arranged upstream of the spray beams in the supply system. Opening positions of the valves are set by a control unit of the cooling section according to a respective sub-flow that is to be applied to the flat rolling stock by means of each spray beam. Also, the delivery rate of the pump and/or a line pressure generated by the pump in the supply system are set by the control unit according to the total flow that is to be applied to the flat rolling stock by means of all the spray beams.

2 Claims, 2 Drawing Sheets

(51) Int. Cl.
*B21B 1/22* (2006.01)
*B21B 37/76* (2006.01)

(52) U.S. Cl.
CPC ..... *B21B 45/0233* (2013.01); *B21B 1/22* (2013.01); *B21B 37/76* (2013.01)

(58) Field of Classification Search
CPC ..... B21B 45/0218; B21B 45/0233; B21B 45/0251; B21B 2261/20
See application file for complete search history.

(56) References Cited

U.S. PATENT DOCUMENTS

| | | | | |
|---|---|---|---|---|
| 9,358,597 | B2 | 6/2016 | Beeston | |
| 2001/0027672 | A1* | 10/2001 | Barten | B21B 37/32 72/201 |
| 2002/0104597 | A1 | 8/2002 | Frank | |
| 2012/0298224 | A1* | 11/2012 | Imanari | B21B 37/74 137/551 |
| 2015/0217351 | A1 | 8/2015 | Sakamoto | |
| 2015/0328670 | A1 | 11/2015 | Aiken | |

FOREIGN PATENT DOCUMENTS

| | | | |
|---|---|---|---|
| CN | 201324757 | Y | 10/2009 |
| CN | 201752716 | U | 3/2011 |
| CN | 102327906 | A | 1/2012 |
| DE | 198 54 675 | A1 | 6/2000 |
| JP | H06-122015 | A | 5/1994 |
| RU | 2466811 | C2 | 11/2012 |
| WO | WO 2014/032838 | | 3/2014 |

OTHER PUBLICATIONS

May 9, 2014 Written Opinion issued in corresponding patent application No. PCT/EP2014/052388.
Jan. 26, 2015 International Prelim. Report issued in corresponding patent app. No. PCT/EP2014/052388.
Jun. 20, 2013 European Search Report issued in corresponding EU patent application No. 13 15 5337.
Jul. 5, 2016 Chinese Office Action issued in corresponding CN Patent Application No. 201480009116.X.
Feb. 28, 2017 Chinese Office Action issued in corresponding CN Patent Application No. 201480009116.X. English Translation.

* cited by examiner

COOLING SECTION COMPRISING POWER COOLING AND LAMINAR COOLING

CROSS-REFERENCE TO RELATED APPLICATIONS

The present application is a divisional under 37 C.F.R. § 1.53(b) of prior U.S. application Ser. No. 14/768,097 filed Aug. 14, 2015, which is a 35 U.S.C. §§ 371 national phase conversion of PCT/EP2014/052388, filed Feb. 7, 2014, which claims priority of European Patent Application No. 13155337.2 filed Feb. 15, 2013, the contents of which are incorporated by reference herein. The PCT International Application was published in the German language.

BACKGROUND OF THE INVENTION

The present invention relates to an operating method for a cooling section for a flat rolling stock, wherein the flat rolling stock is guided through a working region of a number of spray beams, a liquid coolant is fed to the spray beams from a reservoir via a pump and a supply line system, and opening positions of valves arranged upstream of the spray beams within the supply line system are set according to a respective partial flow to be applied to the flat rolling stock by means of the respective spray beam.

The present invention further relates to a control device for a cooling section for a flat rolling stock, wherein the control device sets valves, which are arranged in a supply line system that extends between a reservoir for a liquid coolant and a number of spray beams, according to a respective partial flow to be applied to the flat rolling stock by means of the respective spray beam.

The present invention further relates to a computer program which comprises machine code that can be directly executed by a software-programmable control device, wherein the execution of the machine code by the software-programmable control device has the effect of accordingly forming the control device.

The present invention further relates to a cooling section for a flat rolling stock, wherein the cooling section has a working region through which the flat rolling stock is guided, the working region can be supplied with a liquid coolant by means of a number of spray beams, the liquid coolant is fed to the spray beams from a reservoir for the liquid coolant via a pump and a supply line system, valves are arranged upstream of the spray beams within the supply line system, the cooling section has a control device, and opening positions of the valves are set by the control device according to a respective partial flow to be applied to the flat rolling stock by means of the respective spray beam.

The abovementioned subject matter is generally known.

DE 198 54 675 A1 discloses an operating method for a cooling section for a flat rolling stock, wherein the flat rolling stock is guided through a working region of a number of spray beams. A liquid coolant is fed to the spray beams from a reservoir via a pump and a supply line system.

U.S. Pat. No. 3,423,254 A discloses an operating method for a cooling section for a flat rolling stock, wherein the flat rolling stock is guided through a working region of a number of spray beams. A liquid coolant is fed to the spray beams from a reservoir via a pump and a supply line system.

U.S. Pat. No. 4,720,310 A discloses an operating method for a cooling section for a flat rolling stock, wherein the flat rolling stock is guided through a working region of a number of spray beams. A liquid coolant is fed to the upper and lower rollers from a reservoir via a respective pump and a supply line system. Valves are not present in the supply line system. A respective delivery power of the respective pump is set.

The prior art often involves what is termed laminar cooling. In laminar cooling, the cooling section has a number of spray beams which apply the liquid coolant, either only from above or both from above and from below, onto the flat rolling stock.

More recently, what is termed power cooling is also known. Power cooling, that is, the intensive cooling of hot rolling material is a novel cooling method for cooling a rolling material during or immediately after hot rolling. It serves to set, in a targeted manner, the microstructure and thus the mechanical properties of the end product. In particular, what are termed AHSS (advanced high strength steels) require ever more cooling intensity and cooling flexibility. These requirements are satisfied with power cooling. In power cooling, the spray beams apply markedly greater volume flow rates of liquid coolant to the flat rolling stock than is the case in laminar cooling.

If laminar cooling is to be brought about using a cooling section which is configured for power cooling, it is not sufficient to merely fully open and close the valves arranged upstream of the spray beams. The consequence of this would be that the large quantity of liquid coolant which is required for power cooling is applied to the flat rolling stock. It is therefore necessary to apply, by means of the respective spray beam, a substantially smaller quantity of liquid coolant to the flat rolling stock.

In the prior art, it is known to provide two separate supply line systems, each assigned its own pump. If power cooling is to be carried out, liquid coolant is supplied to the spray beams via one supply line system. If laminar cooling is to be carried out, liquid coolant is supplied to the spray beams via the other supply line system. It is alternatively possible for each of the spray beams to have its own respective valve and for the supply line systems to be unified only downstream of the respective valves. Alternatively, the supply line systems can be unified upstream of the respective valve. In this latter case, the supply line systems are locked with respect to one another, for example by means of check valves.

It would be desirable to be able to supply the spray beams with the liquid coolant via a single supply line system. However, in practice, there is a problem that power cooling requires a relatively high line pressure and that the liquid coolant flowing through the respective valve cavitates if the partial flow of liquid coolant flowing through the respective valve is set to a low value, as is necessary for laminar cooling.

SUMMARY OF THE INVENTION

The object of the present invention is to provide possibilities for supplying the liquid coolant to the spray beams via a single supply line system, and yet to be able to carry out both power cooling and laminar cooling.

According to the invention, an operating method of the above-stated type is improved by the fact that a delivery power of the pump and/or a line pressure generated in the supply line system by means of the pump is set according to a total flow to be applied to the flat rolling stock by means of all of the spray beams together.

This is governed by a control device. A control device is improved by the control device setting a delivery power of a pump arranged upstream of the valves within the supply line system and/or a line pressure generated in the supply line system by means of the pump according to a total flow to be applied to the flat rolling stock by means of all of the spray beams together.

It is possible that the total flow per se is directly known to the control device. Preferably, however, the control device automatically determines the total flow using the partial flows.

A computer program has machine code that is executed by a software-programmable control device and this provides the control device in accordance with the invention.

A cooling section has the features disclosed herein.

According to the invention, a cooling section of the above-stated type is improved by the fact that a delivery power of the pump and/or a line pressure generated in the supply line system by means of the pump are set by the control device according to a total flow to be applied to the flat rolling stock by all of the spray beams together.

On account of the corresponding control of the pump by means of the control device, the line pressure is set between a minimum value and a maximum value. Moreover, the opening settings of the valves can be set in step-free fashion or in various steps between a respective fully closed setting and a respective fully open setting. It is obvious from the configuration according to the invention that, in the event that the line pressure is at the maximum value, there is at least one respective opening setting of the valves in which the liquid coolant flowing through the respective valve cavitates. This is due to the fact that, because of the pump being controlled appropriately, there prevails in the supply line system, in the event that laminar cooling is to be carried out, a line pressure which is markedly lower than the maximum value. The corresponding valve can therefore, because of the relatively low line pressure, be opened relatively wide, such that there is no longer a risk of cavitation.

In the event that the line pressure is at the maximum value, the valves have, at the respective fully open setting, a respective maximum flow and, at the opening setting at which the liquid coolant flowing through the respective valve cavitates, a respective cavitation flow. A ratio of the respective maximum flow to the respective cavitation flow is preferably at most 5:1.

The valves can, as is generally common, be formed as butterfly valves.

The above-described properties, features and advantages of this invention and the manner in which they are achieved become more clearly and distinctly comprehensible in conjunction with the following description of the exemplary embodiments which are explained in more detail in connection with the drawings in which, schematically:

DESCRIPTION OF AN EMBODIMENT

Figure 1:
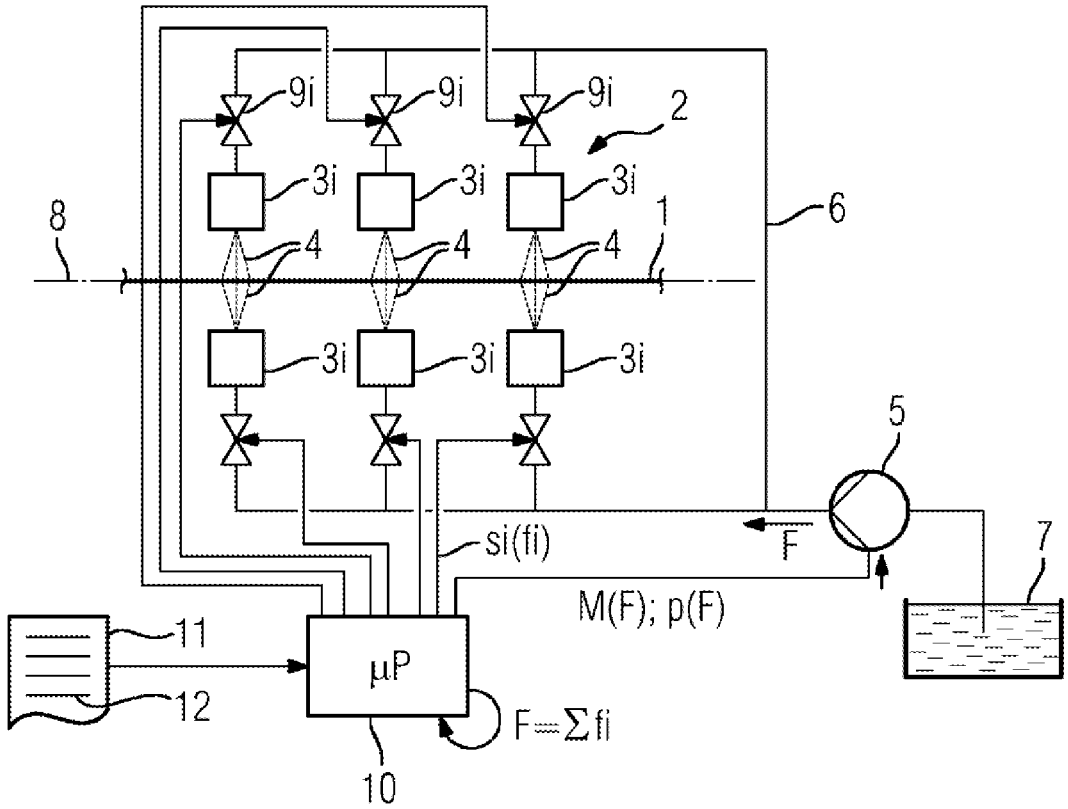
FIG. 1 is a side view of a cooling section.

As shown in FIG. 1, a cooling section for a flat rolling stock 1 has a working region 2 through which the flat rolling stock 1 is guided. A number of spray beams 3*i* (i=1, 2, 3, . . . ) are arranged in the working region 2. The working region 2 can be supplied, by means of the spray beams 3*i*, with a liquid coolant 4. The liquid coolant 4 is fed to the spray beams 3*i* from a reservoir 7 for the liquid coolant 4 via a pump 5 and a supply line system 6. The spray beams 3*i* are generally, as shown in the representation of FIG. 1, arranged both above and below a pass line 8, such that the spray beams 3*i* can apply the liquid coolant 4 to the flat rolling stock 1 both from above and from below the opposite surfaces of the flat stock. In some cases, however, it can be sufficient for the spray beams 3*i* to be arranged only above the pass line 8.

Within the supply line system 6, valves 9*i* are arranged upstream of the spray beams 3*i*. The valves 9*i* or, more specifically, their opening settings si, can be set by a control device 10. The valves 9*i* are controlled by the control device 10 such that the opening settings si of the valves 9*i* are set in accordance with a respective partial flow fi, which is to be applied to the flat rolling stock 1 by means of the respective spray beam 3*i*. Furthermore, the control device sets a delivery power M of the pump 5 in accordance with a total flow F which is to be applied to the flat rolling stock 1 by means of all of the spray beams 3*i* together. As an alternative to the delivery power M, the pump 5 can be controlled in a manner corresponding to the total flow F so as to set a line pressure p which is generated in the supply line system 6 by means of the pump 5. The total flow F can be determined by the control device 10, automatically and directly by summing the partial flows fi.

The control device 10 generally takes the form of a software-programmable control device. This is indicated in FIG. 1 by the fact that the abbreviation μP, for microprocessor, is shown in the control device 10. In this case, the control device 10 is programmed with a computer program 11. The computer program 11 comprises machine code 12 which can be directly executed by the control device 10. In this case, the execution of the machine code 12 by the control device 10 effects the corresponding formation and mode of operation of the control device 10.

Figure 2:
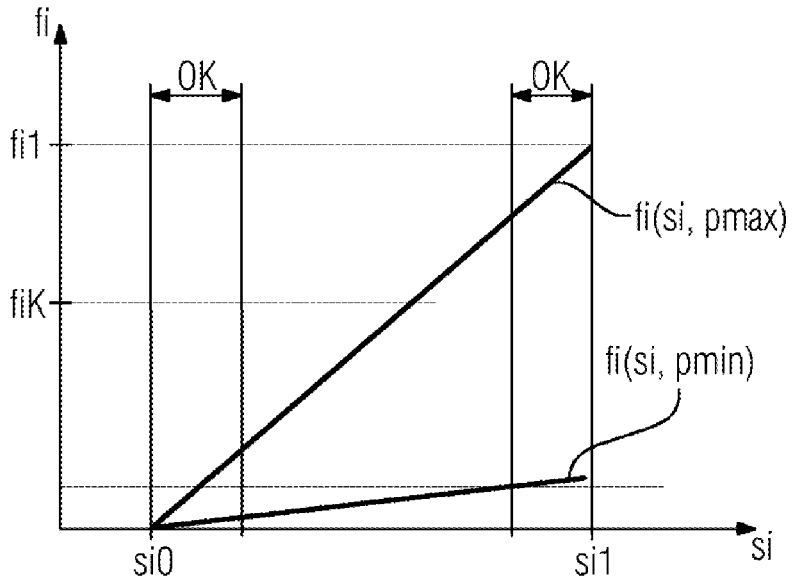
FIG. 2 shows characteristic curves and
FIG. 3 shows a valve in section.

The control device 10 accordingly controls the pump 5 such that the line pressure p in the supply line system 6 can be set between a minimum value pmin and a maximum value pmax. Furthermore, the control device 10 accordingly controls the valves 9*i* such that their opening settings si can be set between a respective fully closed position si0 and a respective fully open position si1. It is possible, as shown in FIG. 2, for the opening positions si to be set in a step-free manner. Alternatively, setting could be effected in multiple steps. A respective partial flow fi corresponds to every opening position si of the valves 9*i*. In addition, the partial flow fi is also, as shown in FIG. 2, dependent on the line pressure p.

In the event that the line pressure p is at the maximum value pmax, there exists, as shown in FIG. 2, at least one respective opening position si of the valves 9*i* at which the liquid coolant 4 flowing through the respective valve 9*i* cavitates, i.e. bubbles form in the liquid coolant 4 flowing through the respective valve 9*i*, downstream of the respective valve 9*i* as seen in the direction of flow.

This effect, which is per se disadvantageous and undesired, can be readily accepted within the context of the present invention because, within the context of the present invention, in order to obtain a certain partial flow fi, it is possible to vary not only the opening position si of the corresponding valve 9*i*, but also the delivery quantity M of the pump 5 and/or the line pressure which the pump 5 generates in the supply line system 6.

The following statements relate to the case in which the line pressure p is at the maximum pressure pmax. As shown in FIG. 2, the liquid coolant 4 flowing through the respective valve 9*i* has, at the respective fully open position si1, a respective maximum flow fi1. At that respective opening position si at which the liquid coolant 4 flowing through the respective valve 9*i* cavitates, the liquid coolant has a lower partial flow fiK, hereinafter termed cavitation flow fiK. The ratio of the respective maximum flow fi1 to the respective cavitation flow fiK is generally at most 5:1. It can also be lower, for example 3:1 or 2:1.

Figure 3:
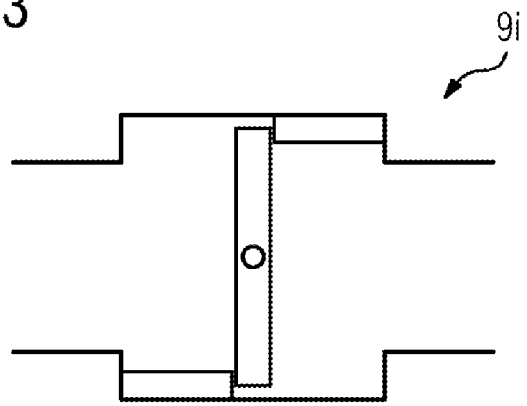

By virtue of the fact that it is possible to avoid cavitation by accordingly reducing the delivery power M and/or accordingly reducing the line pressure p, it is clearly possible for the valves 9*i* to be formed as butterfly valves, as shown in FIG. 3.

The present invention has many advantages. In particular, cavitation can easily be avoided during operation as laminar cooling. Furthermore, it is clearly possible to retro-fit existing power cooling installations. All that is necessary is for the control device 10 to be exchanged or reprogrammed and for the pump 5 to be appropriately capable.

Although the invention was described and illustrated in more detail using the preferred exemplary embodiment, the invention is not restricted by the disclosed examples and other variations can be derived herefrom by a person skilled in the art without departing from the scope of protection of the invention.

LIST OF REFERENCE SIGNS

1 Flat rolling stock
2 Working region
3*i* Spray beam
4 Coolant
5 Pump
6 Supply line system
7 Reservoir
8 Pass line
9*i* Valves
10 Control device
11 Computer program
12 Machine code
F Total flow
fi Partial flows
fiK Cavitation flow
fi1 Maximum flow
M Delivery power
p Line pressure
pmin Minimum value
pmax Maximum value
si Opening positions
si0 Fully closed positions
si1 Fully open positions

What is claimed is:

1. A method for cooling a rolling stock with a liquid coolant, comprising:

guiding the rolling stock through a working region comprised of a plurality of spray beams oriented and configured to spray the liquid coolant on the rolling stock being guided through the working region;

pumping the liquid coolant to the spray beams from a reservoir via a pump and a supply line system to the spray beams;

using a control unit to set opening positions (si) of valves which are arranged upstream of the spray beams and within the supply line system according to a respective partial flow (fi) through the valves to be applied to the rolling stock by means of each respective spray beam; and using the control unit to reduce a delivery power of the pump and/or reduce a line pressure (p) generated by the pump in the supply line system upstream of the valves according to a total flow (F) of the liquid coolant to be applied to the rolling stock by spray from all of the spray beams together by summing all of the partial flows (fi) through the valves arranged upstream of each of the respective spray beams, wherein the control unit further sets the opening positions of the valves arranged upstream of the spray beams to be relatively open wide and reduces the delivery power of the pump and/or the line pressure generated by the pump to avoid cavitation of the liquid coolant in each valve at the set open position of each valve.

2. The method as claimed in claim 1, wherein the rolling stock is a flat rolling stock having flat surfaces on which the spray beams spray coolant.

* * * * *